US005330242A

United States Patent [19]

Lucky, Sr.

[11] Patent Number: 5,330,242

[45] Date of Patent: Jul. 19, 1994

[54] ROTATABLE HYDRAULIC GRAPPLE

[76] Inventor: Bobby D. Lucky, Sr., Rte. 1, Box 160, Bain Rd. NW., Athens, Ala. 35611

[21] Appl. No.: 995,996

[22] Filed: Dec. 23, 1992

[51] Int. Cl.[5] ..... B66C 1/42

[52] U.S. Cl. ..... 294/88; 294/86.41; 294/106; 37/187

[58] Field of Search ..... 294/86.4, 86.41, 88, 294/106, 68.23; 37/183 R, 187, DIG. 9; 414/729, 732, 739, 758, 763

[56] References Cited

U.S. PATENT DOCUMENTS

| | | | |
|---|---|---|---|
| 2,639,937 | 5/1953 | Billings | 294/88 |
| 3,016,260 | 1/1962 | Schrader | 294/88 |
| 3,194,329 | 7/1965 | Wallers | 175/316 |
| 3,231,303 | 1/1966 | LeTourneau | 294/88 |
| 3,413,029 | 11/1968 | Donovan | 294/88 X |
| 3,582,127 | 1/1971 | Johnson | 294/112 |
| 3,759,564 | 9/1973 | Seaberg | 294/88 |
| 3,902,614 | 9/1975 | Roberts et al. | 214/147 |
| 3,908,695 | 9/1975 | Dunbar | 294/88 X |
| 3,914,886 | 10/1975 | Berg et al. | 294/86.41 X |
| 3,966,249 | 6/1976 | Lindqvist | 294/86.41 X |
| 4,005,894 | 2/1977 | Tucek | 294/88 |
| 4,005,895 | 2/1977 | Cullings | 294/65.5 |
| 4,042,272 | 8/1977 | Götzen | 294/88 |
| 4,057,278 | 11/1977 | Götzen | 294/88 |
| 4,129,329 | 12/1978 | Longo | 37/187 X |
| 4,327,943 | 5/1982 | Longo | 136/765 |
| 4,333,676 | 6/1982 | Thumm | 37/183 R X |
| 4,426,110 | 1/1984 | Mitchell et al. | 303/112 |
| 4,542,929 | 9/1985 | Possinger | 294/88 |
| 4,576,406 | 3/1986 | Johnson et al. | 294/86.41 |
| 4,733,895 | 3/1988 | Hawkes | 294/88 |

*Primary Examiner*—Dean J. Kramer

[57] ABSTRACT

A rotatable hydraulic grapple apparatus comprises a yoke assembly having attached to it a hydraulic motor and having within it a channel. A housing is rotatably connected to the yoke assembly and is capable of being rotated by movement of the hydraulic motor. The housing is centered along the longitudinal axis of the yoke assembly such that the longitudinal axes of both the yoke assembly and the housing are collinear. The channel in the yoke assembly communicates with a manifold in the housing. The housing has rigidly attached to it a plurality of chambers, each chamber containing an hydraulic actuator rigidly attached within the chamber. Attached to each hydraulic actuator is a grapple tine. A pressurized fluid supply provides fluid to the yoke assembly channel which communicates the fluid to the housing manifold. The fluid is then communicated from the manifold to each actuator for movement of the actuator which in turn moves the grapple tines. The housing and chambers completely enclose the actuators and the fluid supply to the actuators so that no cavities or fluid lines are exposed to the operating environment of the grapple. The walls of the housing are interconnected in a way which provides greater rigidity to the structure over the prior art.

4 Claims, 7 Drawing Sheets

ROTATABLE HYDRAULIC GRAPPLE

BACKGROUND

The invention relates to a rotatable hydraulic grapple suitable for use in retrieving, lifting, transporting, and unloading materials of various shapes, sizes, and compositions. Various forms of hydraulic grapples exist in the prior art. These prior art designs have certain limiting attributes which this invention overcomes. These limitations include: exposed hydraulic lines or hoses which are susceptible to tearing and other damage because of the environment in which grapples are used; exposed and open cavities among and between the various structural parts of the grapple which tend to get clogged with material and debris thereby inhibiting the effective performance of the grapple; non-rotatable grapples which restrict the grapple user from choosing more preferable and useful orientations of the grapple during its use. The existence of external hoses and lines also restricts the rotatable movement even of those grapples which are rotatable because the distance of rotation is restricted by the length of the lines.

An object of the present invention is to overcome these limitations.

SUMMARY

The objective of this invention is therefore to improve the operation, reliability and the operating performance of rotatable hydraulic grapples and to overcome the problems and disadvantages of prior constructions as discussed above.

According to the invention, a rotatable hydraulic grapple employs a hydraulic motor mounted on a grapple yoke assembly. The grapple yoke assembly is capable of being suspended from a boom. The grapple yoke assembly has in it a channel. Pressurized fluid is provided to the channel from an external source. This can be accomplished in a number of ways, including use of a boom which itself contains a source of hydraulic fluid in the form of a hose or other supplying means which extends from an external supply of pressurized hydraulic fluid along the boom and ending with a fitting or other means for connection to the grapple yoke assembly and the channel located therein. Means for supplying pressurized hydraulic fluid from an external source to a grapple suspended from a boom have been disclosed in the prior art and examples of such can be found in the following U.S. Pat. Nos.: Tucek, 4,005,894 Gotzen, 4,042,272 Mitchell, 4,426,110 Donovan, 3,413,029 Seaberg, 3,759,564 Dunbar, 3,908,695 Berg, 3,914,886 Lindquist, 3,966,249 Thumm, 4,333,676 Johnson, 4,576,406. The motor turns a pinion which in turn makes contact with and turns a ring gear. The ring gear is located on the top of a grapple housing which is connected to the grapple yoke assembly by way of a joining collar. The longitudinal axis of the grapple yoke assembly and grapple housing are collinear such that the grapple housing rotates around the axis of the grapple yoke assembly. The housing contains within it a housing cavity in which is located a fluid manifold. This manifold communicates with the channel located in the grapple yoke assembly and receives from the channel a supply of fluid. The grapple housing has attached to it a plurality of hydraulic actuators, said actuators located within enclosed chambers which extend outwardly and radially from the longitudinal axis of the housing and from the housing cavity. The pressurized fluid is routed from the fluid manifold to the actuators. By routing the fluid to the actuators from the manifold, and with the actuators and the manifold all positioned at a location below the grapple yoke assembly, the grapple housing is able to rotate freely without having its distance of rotation restricted by the length of the hydraulic lines supplying fluid to the actuators. Each actuator is serviced by two hydraulic lines, one line for causing the actuator to move in one direction, and the other line for causing the actuator to move in an opposite direction. Attached to each actuator is grapple tine. Actuation of the hydraulic actuators causes movement of the tines. By positioning the actuators in enclosed chambers, the actuators and the hydraulic lines to the actuators are protected from the environment in which the grapple is used. The configuration of this housing therefore greatly diminishes the possibility for any material or debris getting caught up in any of the structural elements of the grapple. Further, the hydraulic lines are protected from the environment in which the grapple is being used thereby preventing the lines from being damaged by any material or debris. This greatly increases the safe operation of the grapple by reducing the possibility of any of the lines being punctured resulting in a jet of hydraulic fluid streaming from the line. This also prevents the loss of fluid. The use of dual-action actuators increases the safe operation of the grapple by allowing the grapple to remain locked in position even if there is a loss of fluid pressure in the fluid lines which operate the actuators. The use of cylinder stops on the tines stops the movement of the actuators before the piston of the actuator reaches the end of its travel.

An object of this invention is to provide a rotatable hydraulic grapple, the hydraulic lines of which are fully enclosed and not exposed to the working environment of the grapple.

Another object of this invention is to provide a rotatable hydraulic grapple with a housing which encloses the hydraulic lines and actuators so that there are no exposed openings and cavities, thereby eliminating the possibility of material and debris being caught in the grapple.

Another object of this invention is to provide a rotatable hydraulic grapple, the housing of which is constructed in a manner more rigid than the existing art.

Another object of the invention is to provide a rotatable hydraulic grapple, the rotation of which is not restricted by the length of the hydraulic lines.

Another object of this invention is to provide a rotatable hydraulic grapple assembly in accordance with the objects herein stated and which will conform to conventional forms of manufacture and be of simple construction and easy to use so as to provide a device which will be economically feasible and long-lasting and relatively trouble-free in operation.

Another object of the invention is to provide a rotatable hydraulic grapple assembly of such size as to be capable of fitting inside of, and retrieving articles from, trucks, trailers, rail cars, mobile containers, and the like.

Another object of the invention is to provide a rotatable hydraulic grapple with cylinder stops which cause the hydraulic actuators to stop their travel before the actuator pistons reach their full length of travel internal to the actuators themselves, thereby allowing for longer life of the actuators and providing the actuators with a less punishing working application.

Another object of the invention is to provide a rotatable hydraulic grapple which includes a rotary coupling in the yoke assembly and housing of the grapple, which coupling communicates with a fluid manifold located in the housing of the grapple, said housing being rotatably mounted to said yoke assembly. The coupling and manifold being supplied with pressurized fluid from an external source with said fluid being communicated to the grappler actuators, such configuration herein described allowing for rotation of the grappler housing without restriction by the means of communicating the fluid to the actuators.

These, together with other objects and advantages which are herein stated or will become subsequently apparent, reside in the details of construction and operation and herein described and claimed, reference being had to the accompanying drawings forming a part hereof.

BRIEF DESCRIPTION OF THE DRAWINGS

Other and further objects of the present invention will be apparent from the following description and claims when read in conjunction with the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made if desired by those skilled in the art without departing from the invention and the scope of the appended claims. In the drawings:

DETAILED DESCRIPTION

Figure 1:
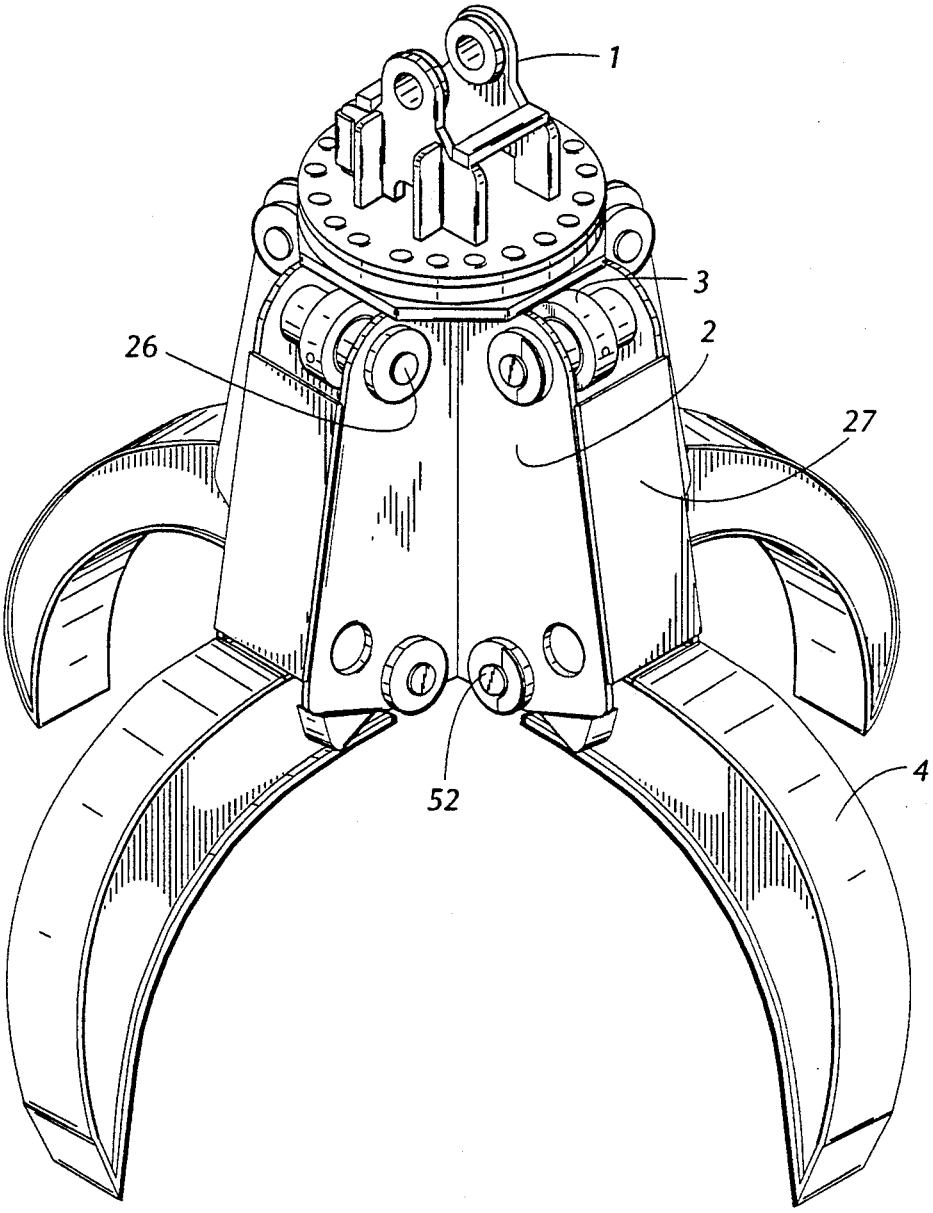
FIG. 1 is a pictorial view of the grapple.

According to FIG. 1, the rotatable hydraulic grapple has a yoke assembly 1 which is rotatably connected to a housing 2 within which are affixed a plurality of hydraulic actuators 3 each of which has attached to it a tine 4.

Figure 2:
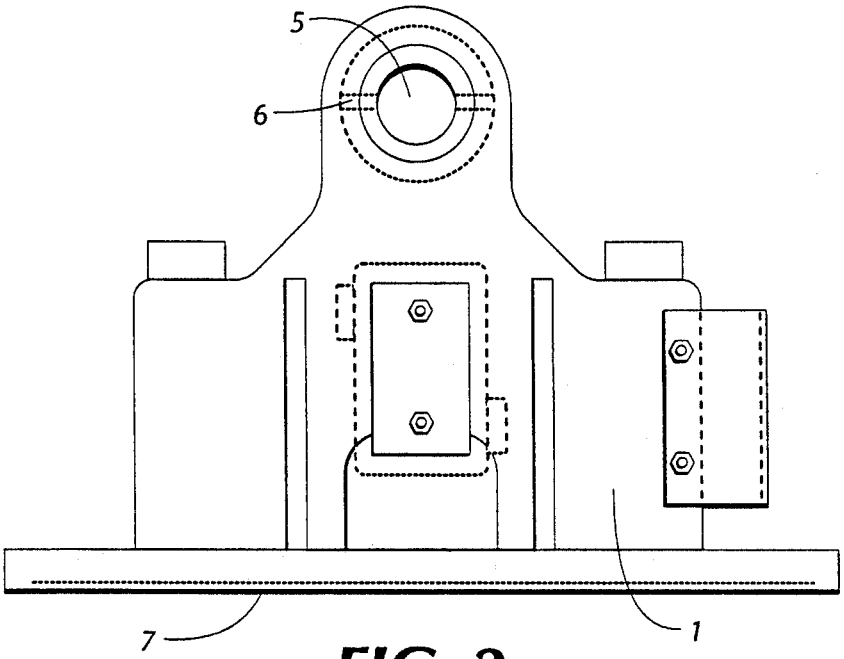
FIG. 2 is a cross section view of the yoke assembly.

According to FIG. 2, the yoke assembly 1 has a yoke pivot pin 5 which can attach to a boom for suspension of the grapple. Said boom can be one of many found in the prior art which include a means for supplying hydraulic fluid under pressure from an external source to the grapple. A yoke keeper pin 6 is used to keep the yoke pivot pin 5 in place. The yoke assembly has a yoke bottom plate 7.

Figure 3:
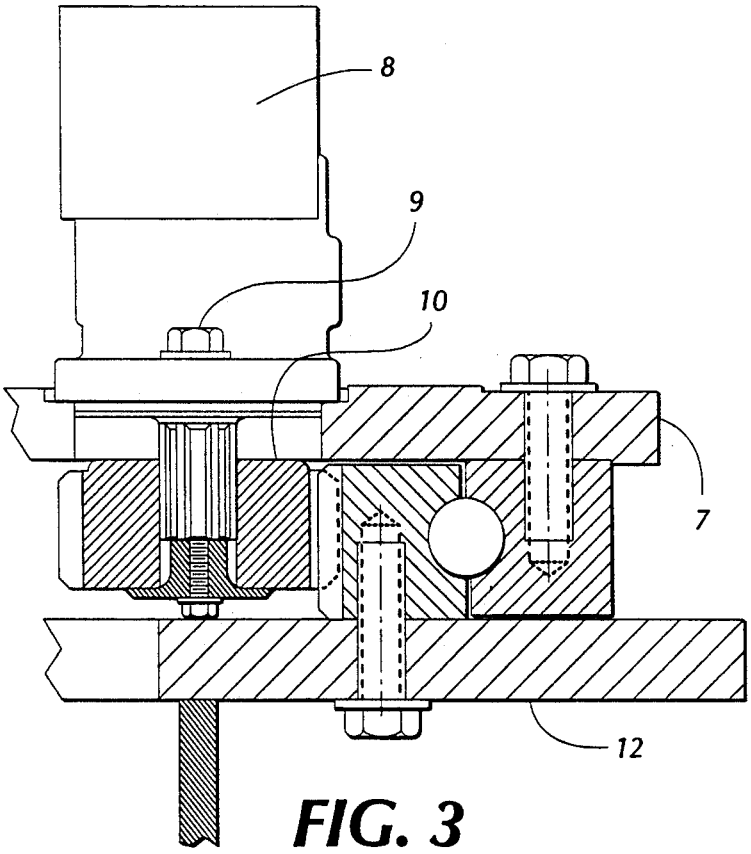
FIG. 3 is a cross section view of the swing motor, the inner ring and the outer ring.
Figure 4:
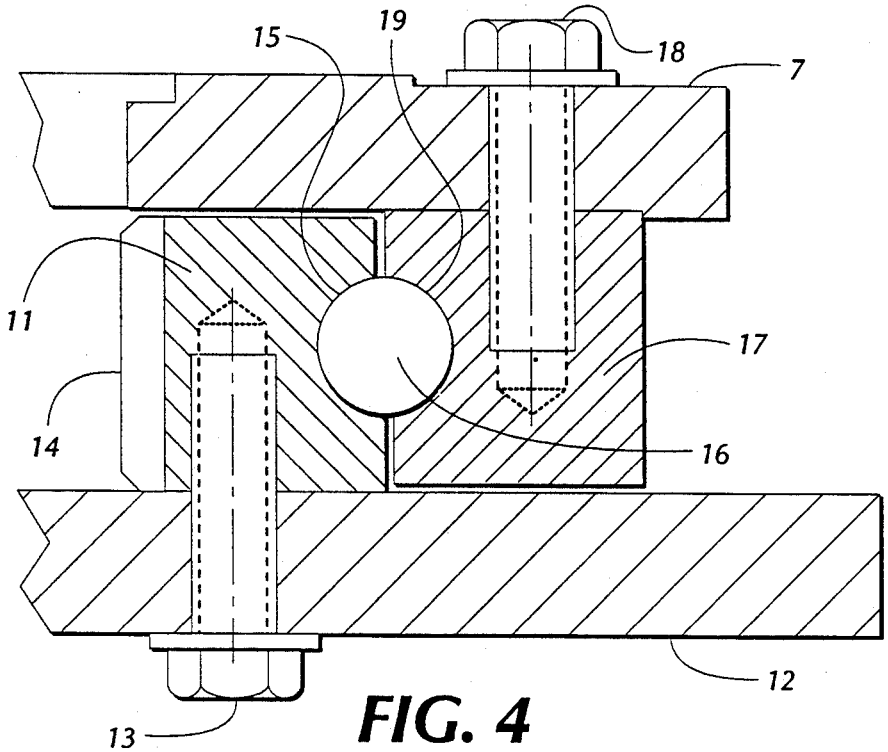
FIG. 4 is a closeup cross section view of the inner ring and the outer ring.

According to FIGS. 3 and 4, a hydraulic swing motor 8 is attached to the top of the yoke bottom plate 7 with a swing motor mounting bolt 9. The swing motor pinion gear 10 is located on the bottom side of the yoke bottom plate 7. As the swing motor pinion gear 10 turns by operation of the swing motor 8, the pinion gear 10 meshes with, and turns, an inner ring 11 which is affixed to a housing upper plate 12 by a plurality of inner ring mounting bolts 13. The inner ring 11 has an inner side containing an inner ring ring gear 14 and an outer side containing an inner ring bearing race 15, said inner ring bearing race 15 for the placement of a plurality of ring ball bearings 16. An outer ring 17 is affixed to the yoke bottom plate 7 by a plurality of outer ring mounting bolts 18. The outer ring 17 has an inner side which contains an outer ring bearing race 19 also for the placement of the plurality of ring ball bearings 16. The inner ring bearing race 15 and the outer ring bearing race 19 are rotatably connected to one another by the plurality of ring ball bearings 16. By this rotatable connection, the swing motor 8 rotates the inner ring 11 and the housing 2 which is connected to the inner ring 11, while the outer ring 17 and the yoke assembly 1 do not rotate. As the housing rotates, all other elements of the grapple affixed to the housing also rotate, including the hydraulic actuators 3 and the tines 4.

Figure 5:
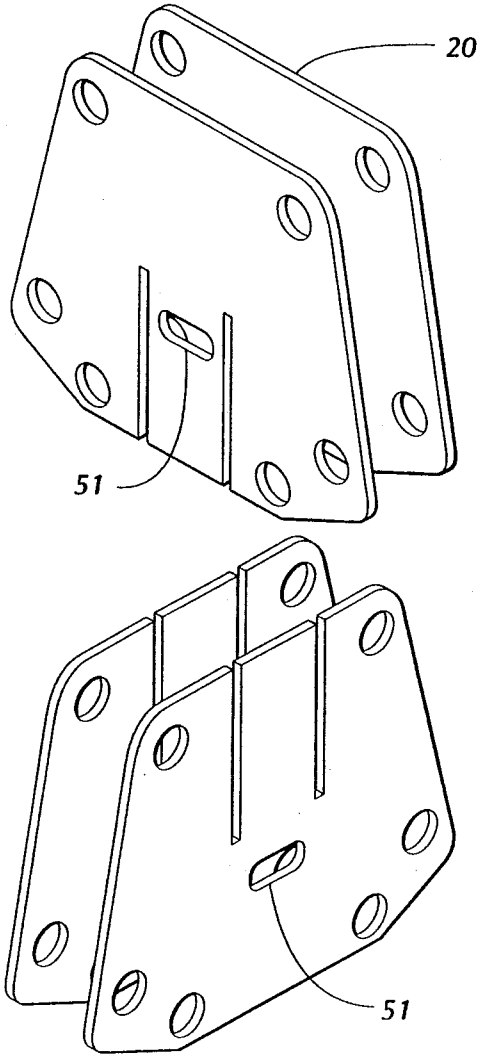
FIG. 5 is a pictorial view of the housing walls and the interconnecting means for interconnecting the housing walls.
Figure 5:
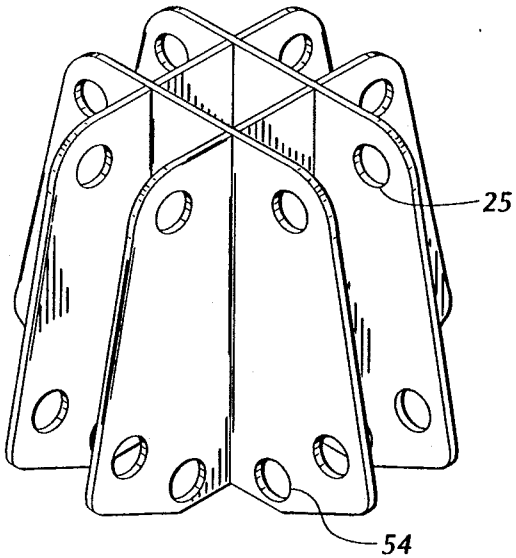

FIG. 5 shows the four housing walls 20 and the manner in which they are interconnected to construct the housing 2.

Figure 6:
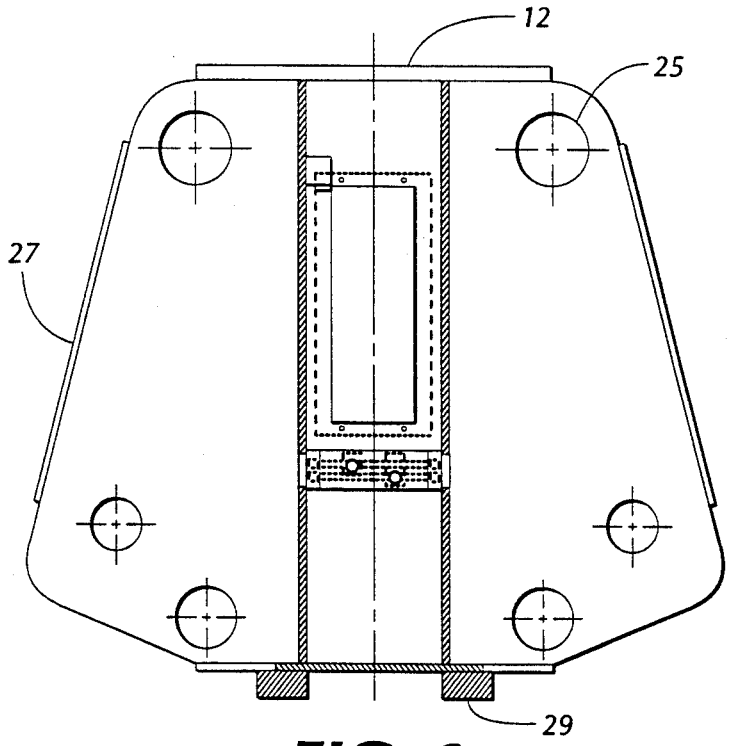
FIG. 6 is a cross section view of the housing walls and housing cavity.
Figure 8:
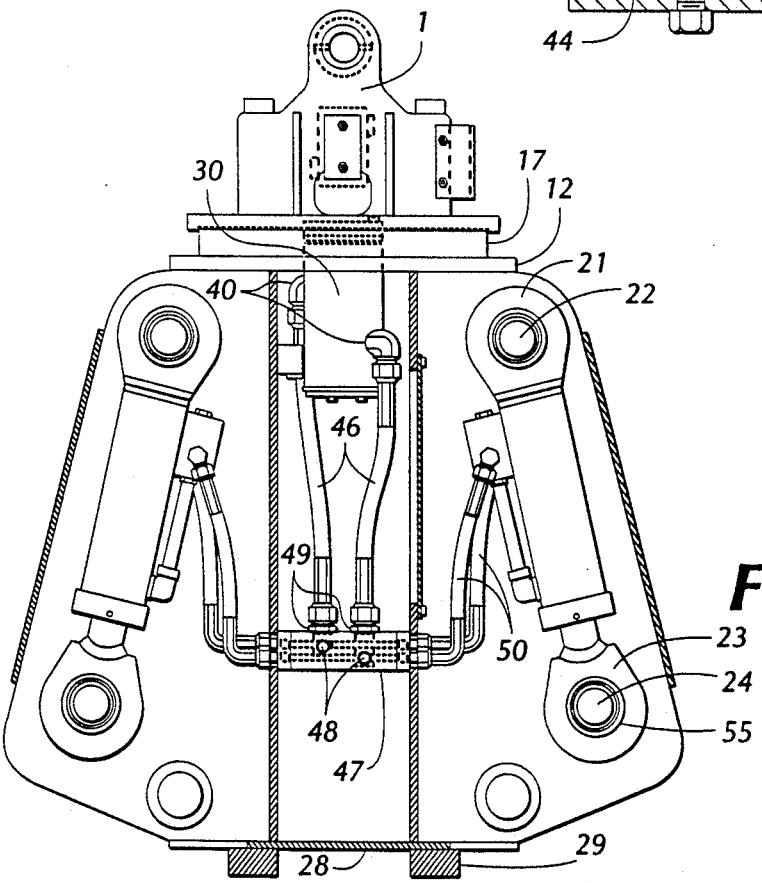
FIG. 8 is a cross section view of the grapple.

Referring to FIG. 8, each hydraulic actuator 3 has a top end 21 having a top end hole 22 and a ram end 23 having a ram end hole 24. Each hydraulic actuator is mounted in between two housing walls at the actuator mounting points 25 by actuator mounting pins 26 which extend through the top end holes 22 and connect to the housing walls 20. Each actuator is enclosed within the housing 20 by affixing an actuator cover plate 27 to the two walls between which the respective actuator is mounted. The housing upper plate 12 is mounted to the top of the housing walls 20 as shown in FIGS. 6 and 8. A housing bottom plate 28 is mounted to the bottom of the housing walls as shown in FIG. 8. In an alternative design, instead of a bottom plate 28, housing bottom stops 29 are affixed to the bottom of the housing walls as shown in FIG. 6.

Figure 7:
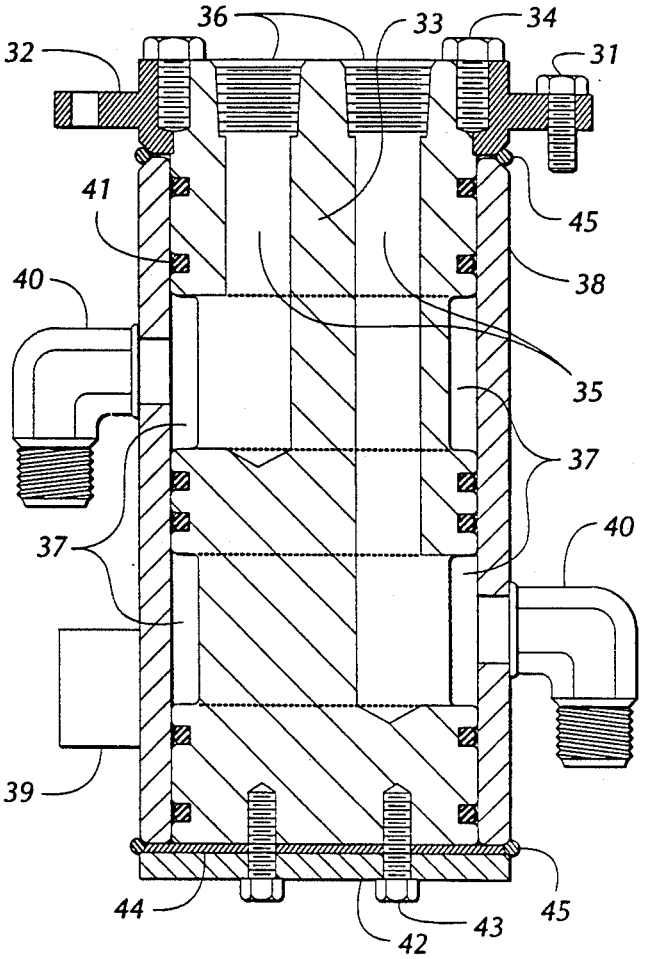
FIG. 7 is a cross section view of the rotary coupling assembly.

FIG. 7 is a cross section view of the rotary coupling assembly. FIG. 8 is a cross section view of the grapple yoke assembly and housing. According to FIGS. 7 and 8, a rotary coupling assembly 30 is located within the housing 2 and is affixed to the yoke bottom plate 7 by a plurality of rotary coupling collar mounting bolts 31 which attach a rotary coupling collar 32 to the yoke bottom plate 7. A rotary coupling core 33 is attached to the rotary coupling collar 32 by a plurality of rotary coupling retainer bolts 34.

Figure 9:
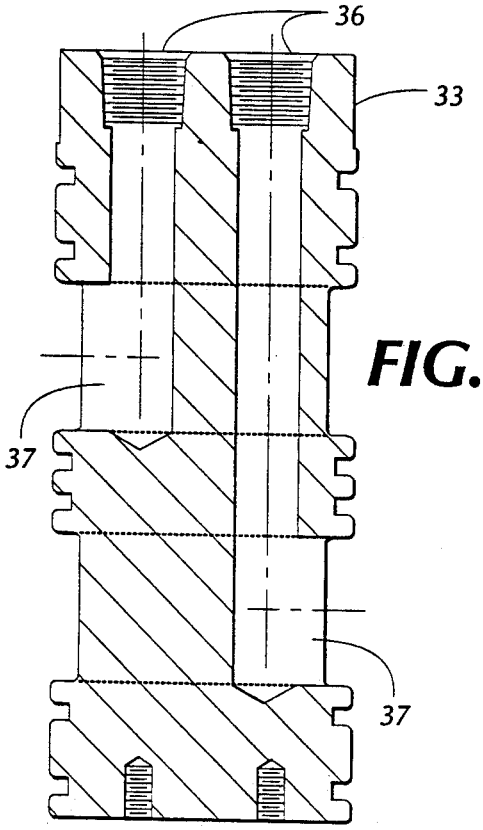
FIG. 9 is a cross section view of the rotary coupling core.

FIG. 9 is a cross section of the rotary coupling core assembly which has within it two rotary coupling core hydraulic channels 35 to which are supplied hydraulic fluid from external sources which connect to each channel at a plurality of external hydraulic source connection points 36. Each rotary coupling core hydraulic channel communicates to one core groove 37. Each core groove extends around the rotary coupling core 33.

Figure 10:
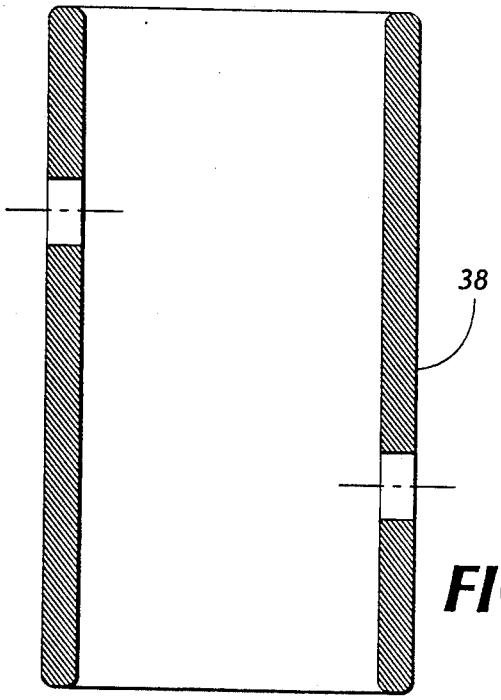
FIG. 10 is a cross section view of the rotary coupling barrel.

FIG. 10 is a cross section of a rotary coupling barrel 38 which fits around the rotary coupling core 33. A rotary coupling barrel stopper 39 is attached to the rotary coupling barrel 38 and makes contact with the housing 2 so that the rotary coupling barrel will rotate with the housing. The rotating coupling core 33, which is attached to the yoke bottom plate 7, does not rotate with the housing. Attached to the rotary coupling barrel 38 at a position centered on each of the core grooves 37, are rotary coupling hydraulic fittings 40. Hydraulic seals 41 are located within the rotary coupling core 33 above and below each core groove 37. A rotary coupling bottom plate 42 is attached to the rotary coupling core 33 by a plurality of rotary coupling bottom plate mounting bolts 43. A thrust plate 44 is sandwiched between the rotary coupling core 33 and the rotary coupling bottom plate 42. O rings 45 are located at the top and bottom of the rotary coupling barrel 38.

As shown in FIG. 8, coupling/manifold hydraulic lines 46 run from the rotary coupling hydraulic fittings 40 to a hydraulic manifold 47. The hydraulic manifold 47 distributes the hydraulic fluid through exit ports 48 to each of the hydraulic actuators 3 using two manifold hydraulic fittings 49 and two manifold hydraulic lines 50 per actuator 3. The exit ports 48 are sized of such diameter so as to limit the volumetric flow of hydraulic fluid to every hydraulic actuator 3 to a specific maximum value. Each housing wall 20 contains a wall slot 51 through which pass the manifold hydraulic lines 50 from the hydraulic manifold 47 to each hydraulic actuator 3.

Figure 12:
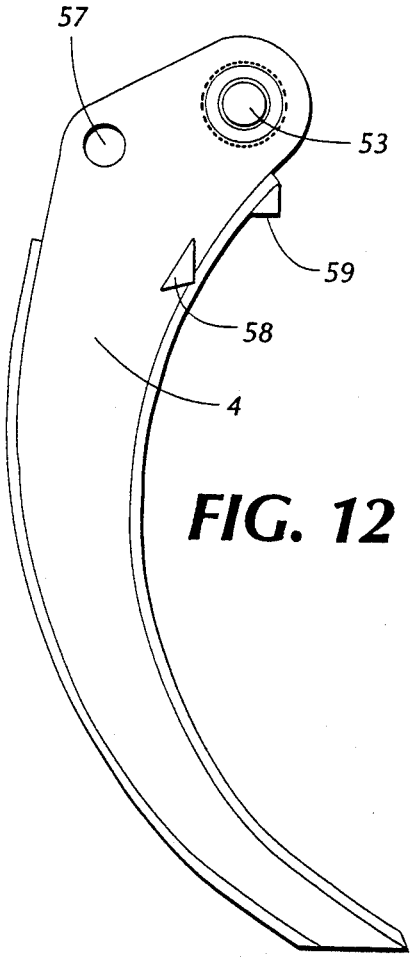
FIG. 12 is a view of one tine.
Figure 11:
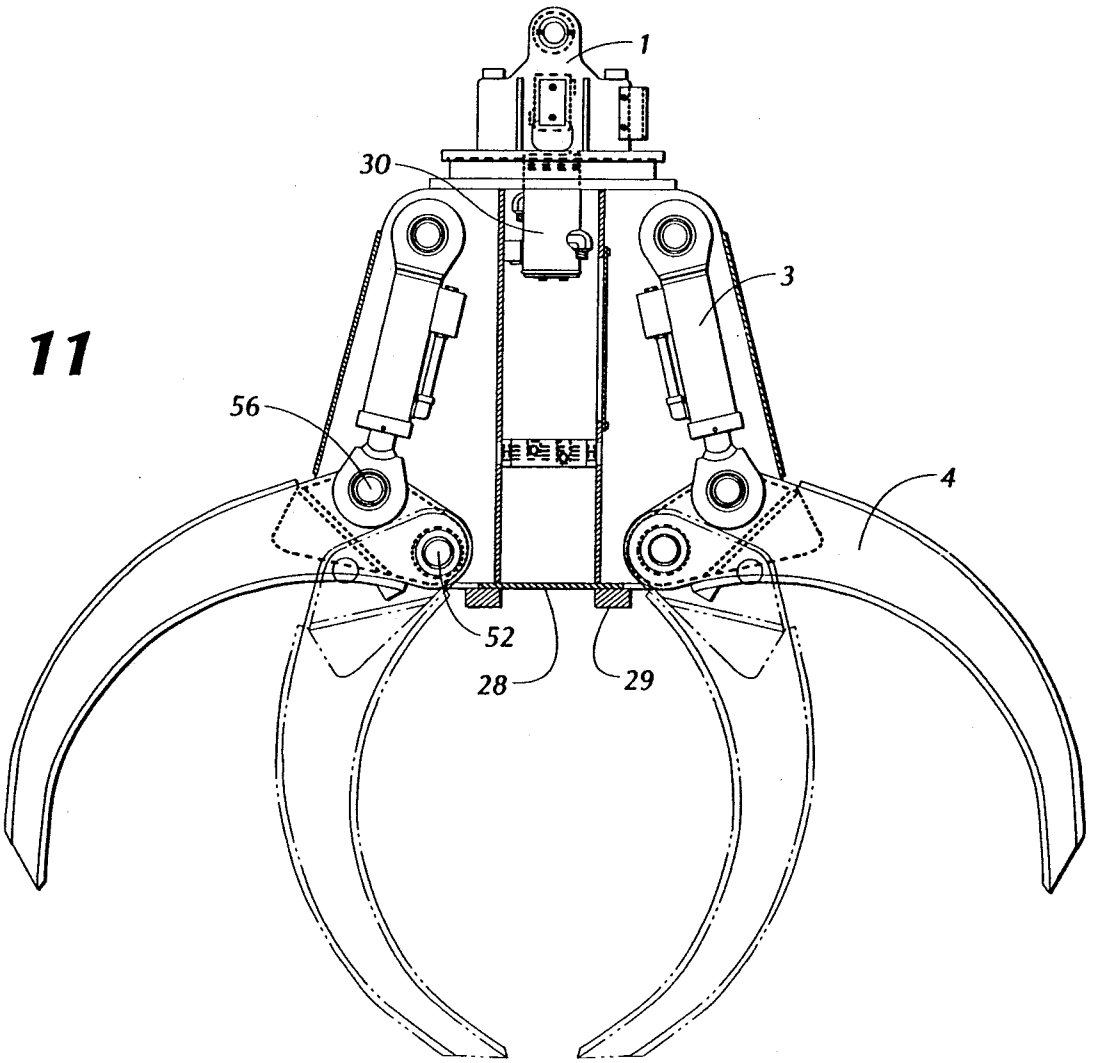
FIG. 11 is a cross section view of the grapple, and grapple tines.

FIG. 11 is a cross section view of the grapple which also depicts the attachment and movement of the tines 4. FIG. 12 is a cross section of one tine. Each tine is rotatably affixed to the grapple by the use of a tine/-housing pin 52 which is fitted through the tine at the tine/housing mounting hole 53 and through and to the housing walls at the tine mounting/pivot points 54. Within each tine/housing mounting hole 53 is a uniball bearing 55 to allow for the lateral movement of each tine 4. Each tine 4 is also attached to a respective hydraulic actuator 3 by the use of a tine/actuator pin 56 which is fitted through the tine/actuator driving hole 57, the uniball bearing 55, and the respective actuator ram end hole 24.

As shown in FIG. 12, upper actuator stops 58 are attached to each side of each tine, and bottom actuator stops 59 are also attached to each tine. When actuated, each tine's upper movement is stopped when its upper actuator stops 58 make contact with the two housing walls within which its respective actuator is located. The tine's downward movement is stopped when its bottom actuator stops 59 make contact with the housing bottom plate 28 of FIG. 8, or with the housing bottom stops 29 of FIG. 6.

What is claimed is:

1. A rotatable grapple, comprising:

a) a yoke assembly having a channel within said yoke assembly;

b) a housing, said housing comprising:

1) a plurality of housing walls;

2) an interconnecting means for interconnecting said housing walls;

3) a plurality of actuator chambers extending radially outward from, and angularly spaced about, the longitudinal axis of the housing, each of said actuator chambers having four sides with three of said four sides being formed by the interconnected housing walls, said three sides consisting of:

(a) an innermost chamber side closet to the longitudinal axis of the housing, said innermost chamber side having a right edge and a left edge, (b) a right chamber side connected to, and extending outwardly from, the right edge of the innermost chamber side, and (c) a left chamber side connected to, and extending outwardly from, the left edge of the innermost chamber side, said right chamber side and said left chamber side being parallel to each other;

4) a plurality of chamber outer plates, each of said outer plates forming the fourth and outermost side of respective ones of the actuator chambers, each outer plate having a right edge connected to respective ones of said right chamber sides and a left edge connected to respective ones of said left chamber sides;

5) the right edge of each of the plurality of innermost chamber sides connecting to the left edge of the innermost chamber side of the adjoining actuator chamber, thereby forming the sides of a housing cavity centered along the longitudinal axis of the housing, said housing cavity communicating with the channel located in the upper yoke assembly;

6) a plurality of hydraulic actuators mounted one each within said actuator chambers;

7) a first communicating means for communicating fluid between the channel located in the yoke assembly and the housing cavity;

8) a second communicating means for communicating fluid between the housing cavity and each of said hydraulic actuators for causing movement of each of said hydraulic actuators;

c) a plurality of tines connected to respective ones of said hydraulic actuators such that movement of said hydraulic actuators effects actuation of said tines;

d) a rotatable attaching means for rotatably attaching said housing to said yoke assembly, the longitudinal axis of said housing being collinear with the longitudinal axis of said yoke assembly;

e) a rotating means for rotating said housing relative to said yoke assembly and about the collinear longitudinal axes of said yoke assembly and said housing;

f) a suspending means for suspending said yoke assembly from a boom, said suspending means including a supplying means connectable to an external source of fluid pressure medium for supplying a fluid medium to said channel of said yoke assembly, and;

g) a stopping means for stopping the actuation of each of said actuators.

2. A rotatable grapple according to claim 1, wherein a) the number of housing walls is four, a first wall, a second wall, a third wall, and a fourth wall, each wall having a top edge and a bottom edge, and a first side edge and a second side edge, each wall having a first slot and a second slot, said slots positioned on said walls such that said slots are perpendicular to said top and bottom edges, and such that the first slot is located at approximately one-third of the distance from the first side edge to the second side edge of each wall, and the second slot is located at approximately two-thirds of the distance from the first side edge to the second side edge of each wall, said slots on said first and second walls beginning at the top edge of the first and second walls and ending at approximately half the distance between the top edge and the bottom edge of said first and second walls, said slots on said third and fourth walls beginning at the bottom edge of the third and fourth walls and ending at approximately half the distance between the bottom edge and the top edge of said third and fourth walls;

b) the interconnecting means is comprised of the mating of the first slot of the first wall with the first slot of the third wall, the second slot of the first wall with the first slot on the fourth wall, the first slot of the second wall with the second slot of the third wall, and the second slot of the second wall with the second slot on the fourth wall;

c) the first communicating means for communicating fluid between the yoke assembly and the housing cavity comprises:

1) a rotary coupling barrel, 2) a rotary coupling core positioned within the barrel, said core extending into the yoke assembly channel and into the housing cavity, 3) two rotary coupling core hydraulic channels located within the coupling core, each channel having a top end and a bottom end, the top end of each channel extending to an opening located at the yoke assembly, said openings for receiving hydraulic fluid from an external source, 4) said core having two core grooves communicating one each with the bottom end of each channel, said grooves extending into and wholly around the circumference of said core, 5) two rotary barrel hydraulic fittings, each attached to the rotary barrel in a position centered on each of the core grooves, 6) two rotary barrel hydraulic lines, each having a top end and a bottom end, the top end of each line connecting to one each of the barrel hydraulic fittings, and the bottom end of each connecting to the second communicating means;

d) the second communicating means for communicating fluid between the housing cavity and each of said hydraulic actuators for causing movement of each of said hydraulic actuators comprising:

1) a hydraulic manifold to which each of the bottom ends of the two rotary barrel hydraulic lines attaches and communicates, 2) a hydraulic manifold cavity within said manifold for the storing and communicating of hydraulic fluid, 3) said cavity having ten separate channels leading out of said cavity, each channel ending at a channel port, 4) two of said channel ports connecting to one each of the rotary barrel hydraulic lines, 5) the other eight channel ports connecting one each to eight actuator hydraulic lines which connect, two actuator hydraulic lines each, to each of the four actuators, 6) each pair of actuator hydraulic lines which connects from the manifold cavity to a respective actuator comprises a first hydraulic line from said manifold cavity to each of said actuators for causing movement of the actuator in a first direction, and a second hydraulic line from said manifold cavity to each of said hydraulic actuators for causing movement of each of said hydraulic actuators in a second direction, and, 7) each channel port of said other eight channel ports is of such size as to control the volumetric flow of hydraulic fluid to each of the four hydraulic actuators to a predetermined maximum value;

e) the stopping means for stopping the actuation of each of said actuators comprises an upward-stopping means and a downward-stopping means, said upward-stopping means comprising eight actuator stops located one each on each side of said tines such that said actuator stops contact said housing walls upon actuation of each of said actuators in the first direction, and said downward-stopping means comprising a bottom plate rigidly affixed to the bottom edges of the four housing walls such that the said actuator stops contact said bottom plate when each of said actuators is moving in the second direction.

3. A rotatable grapple, which comprises;

a. a yoke assembly having a channel within said yoke assembly;

b. a supporting means for supporting said yoke assembly;

c. a housing rotatably attached to said yoke assembly such that the longitudinal axes of both said yoke assembly and said housing are collinear;

d. said housing comprising:

(1) a plurality of housing walls;

(2) an interconnecting means for interconnecting said housing walls;

(3) a plurality of actuator chambers extending radially outward from, and angularly spaced about, the longitudinal axis of the housing, each of said actuator chambers having four sides with three of said four sides being formed by the interconnected housing walls, said three sides consisting of:

(a) an innermost chamber side closest to the longitudinal axis of the housing, said innermost chamber side having a right edge and a left edge, (b) a right chamber side connected to, and extending outwardly from, the right edge of the innermost chamber side, and (c) a left chamber side connected to, and extending outwardly from, the left edge of the innermost chamber side, said right chamber side and said left chamber side being parallel to each other;

(4) a plurality of chamber outer plates, each of said outer plates forming the fourth and outermost side of respective ones of the actuator chambers, each outer plate having a right edge connected to respective ones of said right chamber sides and a left edge connected to respective ones of said left chamber sides;

(5) the right edge of each of the plurality of innermost chamber sides connecting to the left edge of the innermost chamber side of the adjoining actuator chamber, thereby forming the sides of a housing cavity centered along the longitudinal axis of the housing, said housing cavity communicating with the channel located in the upper yoke assembly;

(6) a plurality of hydraulic actuators mounted one each within said actuator chambers;

(7) a first communicating means for communicating fluid between the channel located in the yoke assembly and the housing cavity;

(8) a second communicating means for communicating fluid between the housing cavity and each of said hydraulic actuators for causing movement of each of said hydraulic actuators;

e. a rotating means for rotating said housing about said longitudinal axis of said housing and relative to said yoke assembly;

f. a supplying means for supplying fluid from an external source to said actuators for effecting movement of said actuators;

g. a plurality of tines attached to respective ones of said actuators such that movement of said actuators effects actuation of said tines.

4. A rotatable grapple, which comprises;

a. a yoke assembly having a channel within said yoke assembly;

b. a housing rotatably attached to said yoke assembly such that the longitudinal axes of both said yoke assembly and said housing are collinear;

c. said housing comprising:

(1) a plurality of housing walls;

(2) an interconnecting means for interconnecting said housing walls;

(3) a plurality of actuator chambers extending radially outward from, and angularly spaced about, the longitudinal axis of the housing, each of said actuator chambers having four sides with three of said four sides being formed by the interconnected housing walls, said three sides consisting of:

(a) an innermost chamber side closest to the longitudinal axis of the housing, said innermost chamber side having a right edge and a left edge, (b) a right chamber side connected to, and extending outwardly from, the right edge of the innermost chamber side, and (c) a left chamber side connected to, and extending outwardly from, the left edge of the innermost chamber side, said right chamber side and said left chamber side being parallel to each other;

(4) a plurality of chamber outer plates, each of said outer plates forming the fourth and outermost side of respective ones of the actuator chambers, each outer plate having a right edge connected to respective ones of said right chamber sides and a left edge connected to respective ones of said left chamber sides;

(5) the right edge of each of the plurality of innermost chamber sides connecting to the left edge of the innermost chamber side of the adjoining actuator chamber, thereby forming the sides of a housing cavity centered along the longitudinal axis of the housing, said housing cavity communicating with the channel located in the upper yoke assembly;

(6) a plurality of hydraulic actuators mounted one each within said actuator chambers;

(7) a first communicating means for communicating fluid between the channel located in the yoke assembly and the housing cavity;

(8) a second communicating means for communicating fluid between the housing cavity and each of said hydraulic actuators for causing movement of each of said hydraulic actuators;

d. a rotating means for rotating said housing about said longitudinal axis of said housing and relative to said yoke assembly;

e. a suspending means for suspending said yoke assembly from a boom, said suspending means including a supplying means connectable to an external source of fluid pressure medium for supplying a fluid medium to said actuators for effecting movement of said actuators;

f. a plurality of tines attached to respective ones of said actuators such that movement of said actuators effects actuation of said tines.

* * * * *